US007559786B2

(12) United States Patent
Glaser et al.

(10) Patent No.: US 7,559,786 B2
(45) Date of Patent: Jul. 14, 2009

(54) DIVIDED SPRING ARM

(75) Inventors: Stefan Glaser, Heppenheim (DE); Ralf Dierkes, Lorsch (DE); Bernd Leonhardt, Kirchheim (DE)

(73) Assignee: Tyco Electronics AMP GmbH, Bensheim (DE)

( * ) Notice: Subject to any disclaimer, the term of this patent is extended or adjusted under 35 U.S.C. 154(b) by 0 days.

(21) Appl. No.: 12/017,125

(22) Filed: Jan. 21, 2008

(65) Prior Publication Data

US 2008/0182448 A1 Jul. 31, 2008

(30) Foreign Application Priority Data

Jan. 26, 2007 (DE) ..... 10 2007 004 065

(51) Int. Cl.
*H01R 13/627* (2006.01)

(52) U.S. Cl. ..... 439/354

(58) Field of Classification Search ..... 439/353, 439/354, 357, 358, 350, 351, 352, 355
See application file for complete search history.

(56) References Cited

U.S. PATENT DOCUMENTS 5,496,190 A * 3/1996 Ittah et al. ..... 439/354
5,711,684 A * 1/1998 Inoue et al. ..... 439/354
6,116,939 A * 9/2000 Fukuda ..... 439/354
6,132,233 A * 10/2000 Fukuda ..... 439/357
6,146,183 A * 11/2000 Jinno et al. ..... 439/358
6,174,190 B1 * 1/2001 Tharp et al. ..... 439/352
6,186,819 B1 * 2/2001 Holub ..... 439/358
6,254,418 B1 * 7/2001 Tharp et al. ..... 439/352
6,447,170 B1 * 9/2002 Takahashi et al. ..... 385/53
6,638,096 B1 * 10/2003 Jones et al. ..... 439/352
6,692,288 B2 * 2/2004 Nimura ..... 439/352
6,902,420 B2 * 6/2005 Muro et al. ..... 439/358
6,935,887 B2 * 8/2005 Endo ..... 439/489
7,156,684 B2 * 1/2007 Ichida et al. ..... 439/352
7,160,134 B2 * 1/2007 Ichida et al. ..... 439/352
7,229,306 B2 * 6/2007 Mase et al. ..... 439/354
7,267,569 B2 * 9/2007 Nakamura ..... 439/353
7,347,710 B2 * 3/2008 Ohtaka et al. ..... 439/352
7,402,069 B2 * 7/2008 Shigeta et al. ..... 439/352
7,402,071 B2 * 7/2008 Ohtaka et al. ..... 439/357
2002/0037661 A1 * 3/2002 Endo ..... 439/352
2002/0111060 A1 * 8/2002 Challis et al. ..... 439/352
2003/0003792 A1 * 1/2003 Endo ..... 439/352
2003/0040210 A1 * 2/2003 Herlinger et al. ..... 439/352
2003/0087545 A1 * 5/2003 Nimura ..... 439/352
2005/0082840 A1 * 4/2005 Ichida et al. ..... 292/66
2006/0057881 A1 * 3/2006 Ichida et al. ..... 439/352
2006/0079110 A1 * 4/2006 Ichida et al. ..... 439/352
2006/0134964 A1 * 6/2006 Ohtaka et al. ..... 439/358
2007/0054536 A1 * 3/2007 Nakamura ..... 439/353
2007/0054537 A1 * 3/2007 Nakamura ..... 439/353
2007/0059968 A1 * 3/2007 Ohtaka et al. ..... 439/352
2008/0153341 A1 * 6/2008 Shigeta et al. ..... 439/352

* cited by examiner

*Primary Examiner*—Ross N Gushi
(74) *Attorney, Agent, or Firm*—Barley Snyder LLC

(57) ABSTRACT

A connector for engagement with a corresponding complementary connector is disclosed. The connector has a spring arm having a latch for engagement with the complementary connector. The spring arm also has an actuating arm that at least partially overlaps a locking arm of the spring arm in an actuating direction of the actuating arm. The actuating arm is longer than the locking arm.

20 Claims, 1 Drawing Sheet

DIVIDED SPRING ARM

CROSS-REFERENCE TO RELATED APPLICATION DATA

This application claims the benefit of the earlier filed German patent document DE 10 2007 004 065.4 having a filing date of Jan. 26, 2007.

FIELD OF THE INVENTION

The present invention relates to a connector.

BACKGROUND

Some electrical plugs are provided in electrical plug-in connectors in order to produce a releasable electrical connection between a first electrical line and a second electrical line, or between an electrical line and an electrical device. The electrical plugs may be used in a variety of fields of application, among others, within the industry of vehicle electronics, for example, for use as connector plugs for cigarette lighters. Due to the extreme environmental conditions in this field, high standards must be met with regard to the plug's vibratory strength, resistance to corrosion and temperature, and current-carrying capacity. Furthermore, the connection provided by such a plug must be able to be disconnected and reliably connected again as easily as possible.

A plug is disclosed in U.S. Pat. No. 6,364,686 that comprises a longitudinally divided spring arm with two spring arm portions 14, 15. The spring arm portion 14 has a latching projection 16 that is provided for engagingly connecting to the corresponding opening 20 in the socket 2. The spring arm portion 15 comprises a projection 17 that is provided in order to tightly engage with a correspondingly formed recess 21 in the socket 2. While the object of the latching projection 16 is to ensure a reliable connection between the plug 1 and the socket 2 by means of latching engagement, the object of the projection 17 is to provide a connection between the plug 1 and the socket 2 so that the plug 1 and the socket 2 are not loose relative to each other.

The spring arm portion 14 is further provided with a releasing button 18 by which means the two spring arm portions 14, 15 can be simultaneously actuated in such a way that the plug 1 is released from the socket 2.

However, as plugs of this type are used, above all, in the automotive industry, the plugs pose the danger that, when assembled, they may not properly lock into the socket by means of their latching projection or latch due to the application of force at the spring arm during insertion of the plug into the socket. In other words, while force is necessary for inserting or introducing the plug into the corresponding socket, it is possible that the person assembling the plug may, during assembly, prevent the spring arm from moving and thus block it with one of their fingers, for example a thumb, possibly preventing the plug from properly locking into the socket. If the plug does not properly lock into the socket, the plug can later become disengaged while in use. This is of particular concern with regard to plugs having sealed plug-in connectors since excess pressure may develop that can force an inadequately secured plug out of the socket. This results in undesired failure during operation that is also, to some extent, associated with considerable drawbacks.

SUMMARY

The present invention relates to, in one embodiment among others, a connector for engagement with a corresponding complementary connector. The connector has a spring arm having a latch for engagement with the complementary connector. The spring arm also has an actuating arm that at least partially overlaps a locking arm of the spring arm in an actuating direction of the actuating arm. The actuating arm is longer than the locking arm.

BRIEF DESCRIPTION OF THE DRAWINGS

The features and advantages of the invention will be explained in more detail in the description hereinafter with reference to the attached drawings, in which.

DETAILED DESCRIPTION OF THE EMBODIMENT(S)

Figure 1:
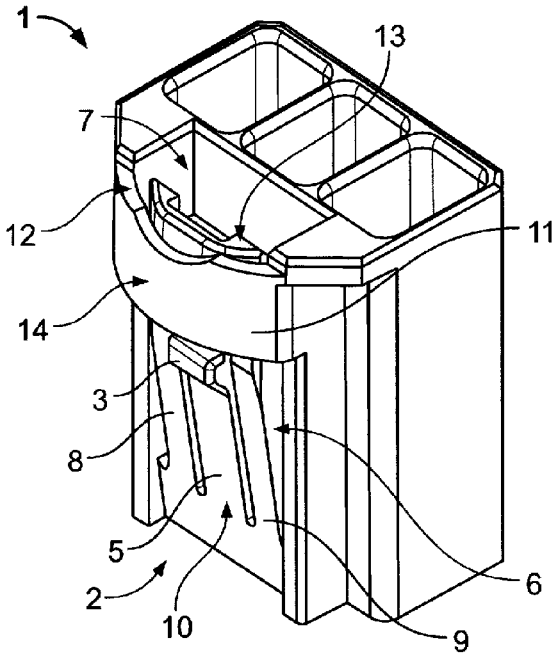
FIG. 1 is an oblique view of a connector according to an embodiment of the present invention.

FIG. 1 shows a connector 1 according to the invention that is made of a melt-processable plastic, such as PVC, and that is formed completely in one piece. Alternatively, it is possible for only a portion of the connector 1 to comprise a polymer material. A further alternative is that the connector 1 may comprise a plurality of individual component parts. The spring arm 2, in this case, comprises a locking arm 5 and an actuating arm 6. The actuating arm 6 comprises two arm portions, a first arm portion 8 and a second arm portion 9. However, in alternative embodiments, the actuating arm 6 may comprise more or fewer than two arm portions. The locking arm 5 comprises a latch 3 and is arranged between the first and second arm portions 8, 9. Further, the locking arm 5 and the first and second arm portions 8, 9 are arranged substantially in the same plane. An actuator 7 connects the first and second arm portions 8, 9 together at their distal ends.

The locking arm 5 and the first and second arm portions 8, 9 of the actuating arm 6 are arranged on the common retaining portion 10 and are formed in one piece therewith. The locking arm 5 and the first and second arm portions 8, 9 are, in this case, moveable counter to one another.

The connector 1 further comprises a guard 11 that at least partially overlaps the actuator 7 in the actuating direction of the actuating arm 6. The guard 11 and the actuator 7 are each formed to be substantially arc-shaped in cross-section. A guard end face 12 of the guard 11 and an actuator end face 13 of the actuator 7 lie substantially in the same plane. Furthermore, the guard 11 comprises a substantially circular segment-shaped notch 14 recessed into the guard 11 from the guard end face 12.

Figure 2:
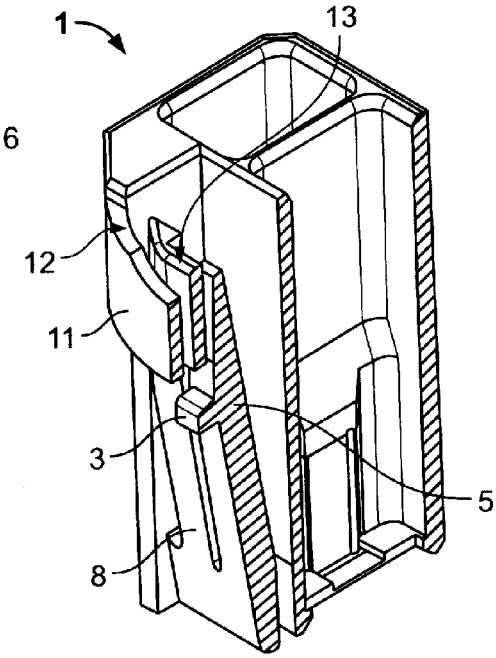
FIG. 2 is an oblique cross-sectional view of the connector of FIG. 1.

FIG. 2 shows the connector 1 according to the invention and according to FIG. 1 in a cross-sectional view. The features which are not visible in the non-cross-sectional view in FIG. 1 will be described hereinafter.

The actuating arm 6 is longer than the locking arm 5 so the actuating arm 6 projects over the distal end of the locking arm. The actuator 7 overlaps a distal region of the locking arm 5 in the actuating direction of the actuating arm 6. Furthermore, the actuator 7 is set apart from the portion of the locking arm which is overlapped by the actuator 7. The guard 11 virtually completely overlaps the actuator 7. Only the circular segment-shaped notch 14 leaves a small region of the actuator 7 uncovered.

Figure 3:
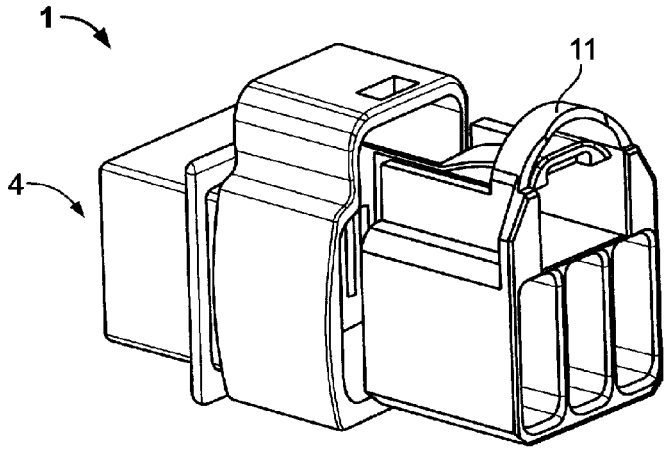
FIG. 3 is an oblique view of the connector of FIG. 1 connected to a complementary connector.

FIG. 3 is a perspective view of the connector 1 according to the invention and according to FIGS. 1 and 2, which is partially inserted into a corresponding complementary connector 4 of the present invention.

The above-described connector allows direct application of force at the locking arm 5 and thus also the possibility of the locking arm 5 being prevented from moving or being blocked during assembly by a person's finger. Further, direct force can be applied solely to the actuating arm. Still further, since the actuating arm 6 projects over the distal end of the locking arm 5, the locking arm 5 can be prevented from being actuated or can be blocked during assembly.

The actuator 7 is used to initiate separation of the connector 1 and the complementary connector 4. When the actuator 7 overlaps the locking arm 5 in the actuating direction of the actuating arm 6, intentional actuation of the actuator 7 is facilitated. When the actuator arm 6 comprises two arm portions, the mechanical stability of the actuating arm 6 is improved.

When the locking arm 5 and the actuating arm 6 are moveable counter to one another, the locking arm 5 may move while the actuating arm 6 remains unmoved.

When the actuator 7 is set apart from the portion of the locking arm 5 that is overlapped by the actuator 7, the likelihood of the locking arm 5 being unintentionally actuated by the actuating arm 6 is decreased while rattling noises caused by vibration are also decreased.

The guard 11 reduces the likelihood of damaging the spring arm 2 or unintentionally applying force to the spring arm 2. When the guard 11 is substantially arc-shaped in cross-section, stability is easily achieved.

When guard end face 12 of the guard 11 and an actuator end face 13 of the actuator 7 lie substantially in the same plane the actuator 7 does not project over the guard 11, avoiding unintentional actuation or damage of the actuator 7. Also, the guard 11 does not project over the actuator 7 in such a way that, during assembly, a larger effective contact surface is produced for inserting the connector 1 into a complementary connector 4. Consequently, the assembler's finger that is being used can, for example, be supported both at the actuator 7 and at the guard 11.

When the connector 1 comprises a polymer material, for example, a melt-processable plastic, construction of the connector 1 is cost-effective and can also be formed comparatively easily into complex shapes. Further, polymer materials are normally only very slightly electrically conductive which makes them suitable for insulative electrical connectors such as connector 1 and complementary connector 4.

What is claimed is:

1. A connector for engagement with a corresponding complementary connector, comprising:

a spring arm comprising a latch for engagement with the complementary connector, the spring arm further comprising an actuating arm that at least partially overlaps a locking arm of the spring arm in an actuating direction of the actuating arm, and wherein the actuating arm is longer than the locking arm; and a guard overlapping the actuating arm at least in part in the actuating direction.

2. The connector according to claim 1, wherein the actuating arm projects over a distal end of the locking arm.

3. The connector according to claim 1, wherein the locking arm and the actuating arm are both arranged on a common retaining portion.

4. The connector according to claim 1, wherein the locking arm and the actuating arm are moveable counter to one another.

5. The connector according to claim 1, wherein the latch is arranged on the locking arm.

6. The connector according to claim 1, wherein the guard and the actuator are set apart from one another at least when the connector is not connected to the complementary connector.

7. The connector according to claim 1, wherein the guard is substantially arc-shaped in cross-section.

8. The connector according to claim 1, wherein a guard end face of the guard and an actuator end face of the actuator lie substantially in the same plane.

9. The connector according to claim 8, wherein the guard comprises a substantially circular segment-shaped notch starting from the guard end face.

10. The connector according to claim 1, wherein the locking arm and the actuating arm are formed integrally as one piece.

11. The connector according to claim 1, wherein the connector comprises a polymer.

12. The connector according to claim 11, wherein the polymer is a melt-processable plastic.

13. The connector according to claim 1, wherein in the actuating arm comprises an actuator.

14. The connector according to claim 13, wherein the actuator at least partially overlaps the locking arm in the actuating direction of the actuating arm.

15. The connector according to claim 14, wherein the actuator is set apart from the portion of the locking arm that is overlapped by the actuator at least when the connector is not connected to the complementary connector.

16. The connector according to claim 13, wherein the actuating arm comprises a first arm portion and a second arm portion.

17. The connector according to claim 16, wherein the actuator at least partially connects the first arm portion to the second arm portion.

18. The connector according to claim 16, wherein the locking arm, the first arm portion, and the second arm portion all lie substantially in the same plane at least when the connector is not connected to the complementary connector.

19. The connector according to claim 16, wherein the locking arm is arranged between the first arm portion and the second arm portion.

20. An electrical connection system comprising:

a connector comprising a spring arm comprising a latch and an actuating arm that at least partially overlaps a locking arm of the spring arm in an actuating direction of the actuating arm;

a guard overlapping the actuating arm at least in part in the actuating direction; and a corresponding complementary connector for engagement with the connector;

wherein the latch engages with the complementary connector; and wherein the actuating arm is longer than the locking arm.

* * * * *